US005636971A

United States Patent [19]

Renedo Puig et al.

[11] Patent Number: 5,636,971

[45] Date of Patent: Jun. 10, 1997

[54] REGULATION OF FLUID CONDITIONING STATIONS

[76] Inventors: Jordi Renedo Puig; Isabel Rouco Martinez, both of C. Verge dels Dolors, 23, 08960 Sant Just Desvern (Barcelona), Spain

[21] Appl. No.: 201,525

[22] Filed: Feb. 25, 1994

[30] Foreign Application Priority Data

Mar. 2, 1993 [ES] Spain ..... 9300399

[51] Int. Cl.[6] ..... F04B 41/06

[52] U.S. Cl. ..... 417/5; 417/38; 417/44.2; 417/53

[58] Field of Search ..... 417/2, 5, 7, 8, 417/38, 42, 44.2, 43, 53, 18–20, 25

[56] References Cited

U.S. PATENT DOCUMENTS

| | | | |
|---|---|---|---|
| 3,160,101 | 12/1964 | Bartoseski et al. | 417/7 |
| 3,511,579 | 5/1970 | Gray et al. | 417/25 |
| 3,744,932 | 7/1973 | Prevett | 417/8 |
| 3,786,835 | 1/1974 | Finger | 417/7 |
| 3,835,478 | 9/1974 | Molus | 417/7 |
| 3,844,683 | 10/1974 | Albert | 417/7 |
| 4,259,038 | 3/1981 | Jorgensen et al. | 417/5 |
| 4,281,968 | 8/1981 | Akers | 417/38 |
| 4,341,983 | 7/1982 | Gottliebson | 417/7 |
| 4,502,842 | 3/1985 | Currier et al. | 417/8 |
| 4,580,947 | 4/1986 | Shibata et al. | 417/8 |
| 4,655,688 | 4/1987 | Bohn et al. | 417/5 |
| 5,020,972 | 6/1991 | Nakayama et al. | 417/37 |
| 5,190,442 | 3/1993 | Jorritsma | 417/38 |

*Primary Examiner*—Timothy Thorpe
*Assistant Examiner*—Xuan M. Thai
*Attorney, Agent, or Firm*—Steinberg, Raskin & Davidson, P.C.

[57] ABSTRACT

An arrangement for regulating fluid conditioning stations including a plurality of pumping devices, at least one fluid storage reservoir, at least one pressure transducer and regulating mechanism, the conditioning station providing a fluid at a certain pressure and flow for consumption. The pumping devices start and stop such that the pressure in the fluid storage reservoir or reservoirs is maintained between two limit values of pressure (the start pressure and the stop pressure). Only one pumping device is started when the pressure in the storage reservoir(s) reaches or exceeds the value of the start pressure or when the flow provided by the pumping devices in operation is less than the consumption flow. Only one pumping device is stopped when the pressure in the storage reservoir(s) reaches the value of the stop pressure or when the flow provided by the pumping devices in operation is greater than the consumption flow.

18 Claims, 12 Drawing Sheets

FIG. 2
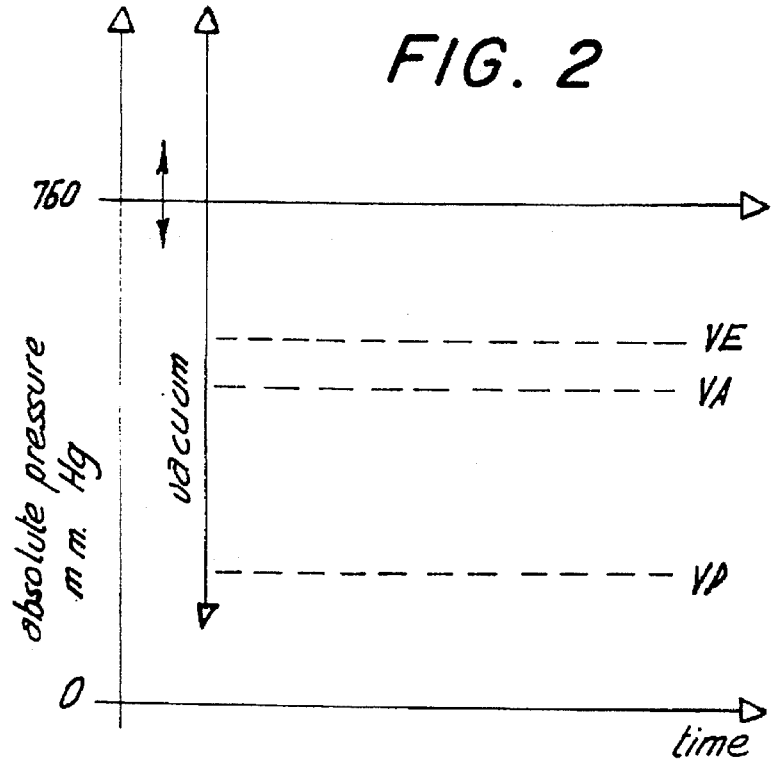
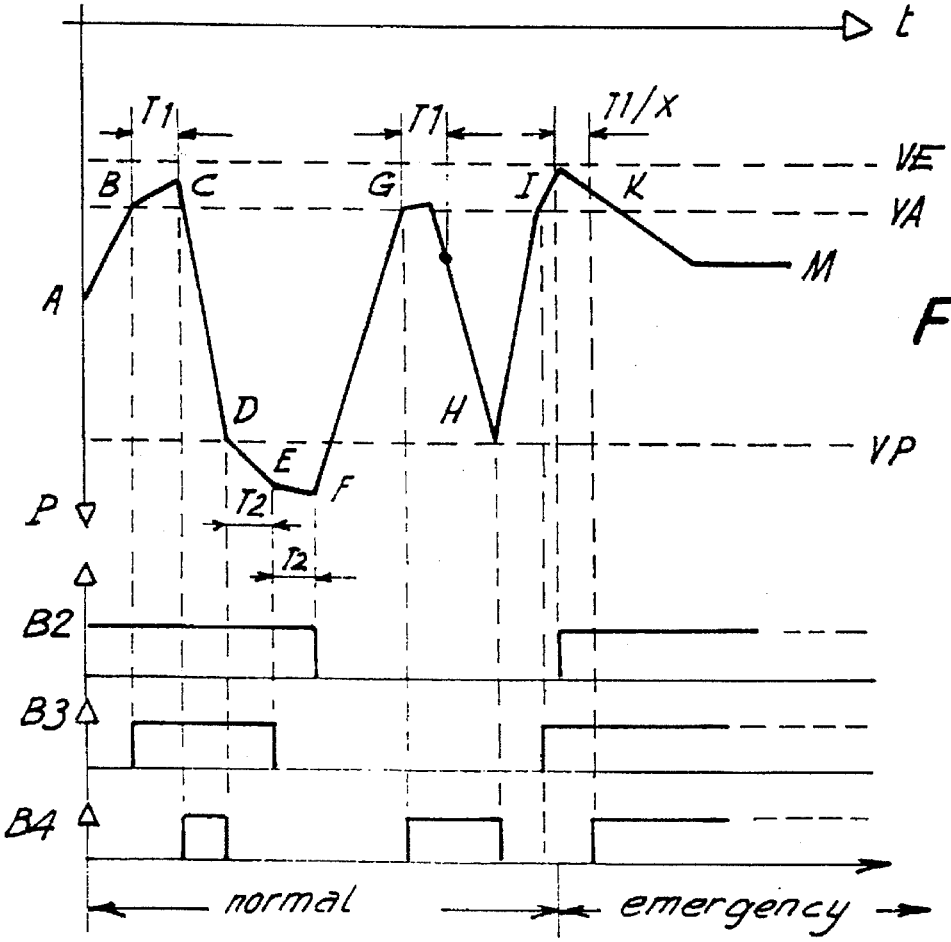
FIG. 3

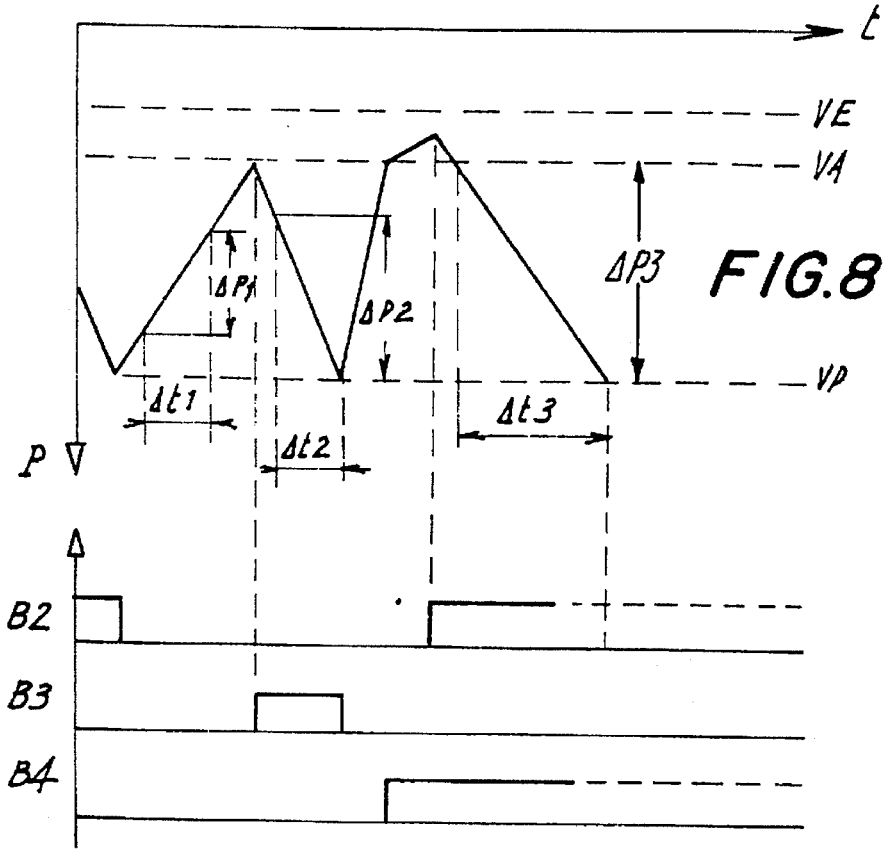
FIG.8
FIG.9
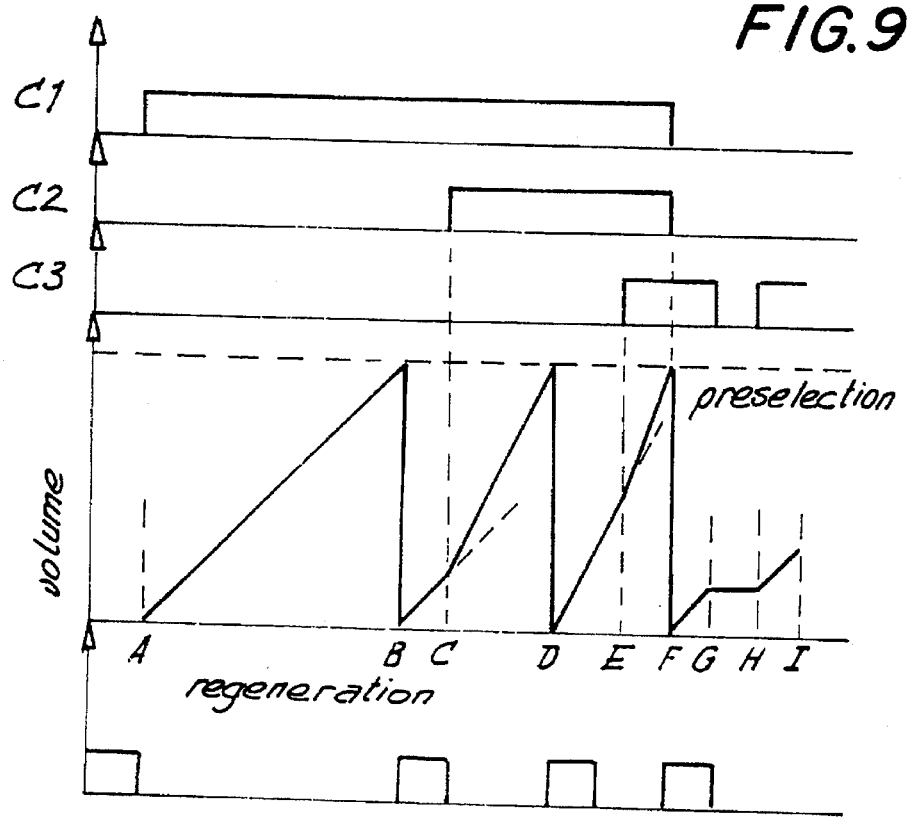

REGULATION OF FLUID CONDITIONING STATIONS

FIELD OF THE INVENTION

The present invention relates to improvements in the regulation of fluid conditioning stations which comprise a plurality of pumping devices, at least one fluid storage reservoir, at least one pressure transducer and regulating means, the conditioning station providing a fluid at a certain pressure and flow for consumption.

In stations of this type the pumping devices are started and stopped such that the pressure in the fluid storage reservoir or reservoirs is maintained between two limit values of pressure known as the start pressure, which is determined according to certain minimum values that have to be maintained, and the stop pressure, which is determined according to the number of start-ups of the pumping devices per unit time.

The term "fluid conditioning stations" refers herein especially to stations with compressors, both the vacuum type and the type using gases above atmospheric pressure. Vacuum pumps normally work at a variable suction pressure and a constant output pressure. Most compressors, on the other hand, work at a constant suction pressure and a variable output pressure.

The treatment stations described are designed to transmit a certain power conditioning the variables pressure and flow.

The invention also relates to improvements in the regulation of stations which condition other variables such as the temperature and flow of a fluid such as water or thermal oil. The fluid may be of any type: solid liquid or gas.

BACKGROUND OF THE INVENTION

These stations have the problem of adapting the pumping devices to the consumption, which s randomly distributed and which may vary over a wide range of values.

As has been said, the pumping devices start and stop such that the pressure in the fluid storage reservoir or reservoirs is maintained between two limit values of pressure: the start pressure which depends on certain minimum values that have to be maintained and the stop pressure, which depends on the number of start-ups per unit time.

The starting and stopping of the pumping devices is an ON/OFF operation and does not in any way take into account the possibility of adapting the station to the consumption.

Therefore, in order to guarantee the consumption requirements during peak hours, pumping stations tend to be oversized. This leads to frequent starting and stopping, since when the consumption is low the storage reservoirs are emptied very quickly in the case of vacuum, or fill very quickly in the case of positive pressures. The oversizing also means that the stations work for long periods of time consuming much more power than is strictly necessary for the consumption required. In no other way can one regard the high hysteresis set tip in order to guarantee a reduced number of start-ups.

This regulating system therefore involves a considerable waste of energy, as well as a high rate of wear of the pumping devices which reduces their life.

Furthermore, the start and stop conditions do not guarantee that the flow supplied by the set of pumping devices is suitably controlled. In fact it only controls the variable pressure directly.

DESCRIPTION OF THE INVENTION

The present invention solves the above mentioned drawbacks, the operation of the pumping devices adapting to the consumption requirements.

The improvements in the regulation of pumping stations which form the object of the invention are characterized in that only one pumping device is started when the pressure in the storage reservoir or reservoirs reaches or exceeds the value of the start pressure or the flow provided by the pumping devices in operation is less than the consumption flow.

This characteristic enables stepped increases and decreases to be guaranteed, with as many steps as there are pumping devices in the peak flow considered in the most simple version. In more complicated versions, with dissimilar pumping devices, even more steps can be obtained by combining the values.

The improvements are further characterized in that only one pumping device is stopped when the pressure in the storage reservoir or reservoirs reaches the value of the stop pressure and/or the flow provided by the pumping devices in operation is greater than the consumption flow.

In this way, the pumping devices adapt progressively to the changing consumption or in the case of a constant consumption there is at most an oscillation of±1 pumping unit (in the case that they are all the same).

It should be remembered that the flows are measured at the operational pressure, a fact which is extremely important in the case of vacuum pumps.

In one embodiment of the invention the difference between the flow provided by the pumping devices and the consumption flow is determined from the change in pressure a after a certain interval of time after connection/disconnection, that is a start or stoppage of one of the pumps, such that if after this interval of time the pressure is still beyond the start/stop pressure a new pumping device is started/stopped.

Advantageously the interval of time depends on different parameters, such as the flow of the pumping devices, the star/delta switching time of the motors which drive the pumping devices, the volume of the storage reservoirs and the start pressure.

Strictly speaking, this time interval consists of three distinct components:

- the dead time until the pumping elements are effective (when being started) or stop being effective (when being stopped).
- the reaction time in order for the pressure to change reaching or not previous pressures to exceed the start/stop pressure.

In an emergency the interval of time is reduced in order that the pumping devices become operational more quickly.

An emergency situation is taken to refer to that in which the start pressure having been exceeded, there is a risk of being unable to guarantee, or it is no longer possible to guarantee the minimum value to be maintained which is used to determine the start pressure.

When operating above atmospheric pressure for example in the case of compressors, all the pumping devices in operation stop if, having exceeded the stop pressure a safety pressure, a level above the stop pressure is reached.

In these devices there is risk that the increasing pressure can cause the fluid storage reservoirs to explode. The safety pressure level is set above the working pressures and in accordance with the pressure admissible in the reservoirs.

According to another embodiment, the values of the start and stop pressures are different for each of the pumping devices.

For example, in vacuum and at certain consumption levels, when several pumps are operating, whether the last pumping device is operating or not is not a factor for the stop value to be reached if it is operational nor for the start value to be reached if it is stopped; the level of pressure is simply varied. Therefore, if the minimum values are guaranteed the operation of this pump is a waste and does not provide optimum operation.

The staggered start values regulate the entry into cascade as the consumption is increased, whilst the stop values discriminate the exit in sequence, minimizing the start-ups.

This condition tends to minimize the number of start-ups.

Two illustrative limit cases can be described: that the flow of the station is slightly greater than the consumption, and that the flow of the station is very much greater than the consumption.

In the first case, the accumulative effect of the differences cause the stop value to be reached. The disconnection of only one pump means that the next start-up is produced much later than if all the pumping devices are stopped.

In the second case, it is simply a problem of adaptation: the total flow of the station is reduced to adapt it to the variation in demand.

According to another embodiment, when the pressure in fluid the storage reservoir or reservoirs reaches the stop pressure, stopping only occurs as long as a certain number of start/stop cycles for each pumping element is not exceeded, it being possible, in a certain interval of time, to substitute stopping for operation without pumping.

Operation without pumping is known in the field as "stand-by" operation, during which the inlet and outlet valves act so as to produce no variation in pressure. In this way, the start-ups are minimized and the energy consumption is minimized, since the energy consumed is used only to overcome friction and maintain the devices operational, no energy at all being consumed for compressing.

Preferably, in this embodiment the time for which the start-ups are minimized is the last sixty minutes. This is the time in which the manufacturers normally give the maximum number of start-ups recommended from both the electrical and mechanical point of view. In fact it can be any other amount of time used to this end.

Also advantageously, and in an alternative way, the stopped situation, or operation without pumping, is determined from the minimum duration of a stop/start cycle, the count of tile duration of the cycle being started at the moment each pumping device is stopped, it being not possible to stop the pumping device before the minimum cycle has finished.

If the station is provided with the right equipment it can pump without stopping (stand-by), with the resulting saving in energy and reduction in wear.

If the time count is carried out as of the moment of start-up, the pumping device would not be able to restart, thereby leading to the risk of being unable to guarantee the minimum values.

If the control is carried out based on minimum operation time, the results from the energy point of view are not too brilliant.

The minimum cycle depends on the maximum frequency recommended by the manufacturer of the pumping device in question. For example, if the maximum frequency is 20 start-ups per hour, the minimum cycle will be (60 minutes/20 start-ups=3 minutes).

If there is no stand-by possibility in the case of vacuum stations the minimum operation which does not exceed maximum frequency given by the manufacturer can be used. Although this may not be very energy efficient it is a good mechanical solution.

In this embodiment the high working frequencies (cycles/hour) are clipped by the mere fact that the stations are made to work continuously or on stand-by until the necessary time has passed to guarantee that the pre-determined maximum number of start-ups has not been exceeded. This can be carried out on an hourly basis or by individual cycle. This embodiment can be applied only to the set of improvements described, but also to the regulating procedures in existence until now.

According to another embodiment, the difference between the flow provided by the pumping devices and the consumption flow is determined from the known flow of each of the pumping devices, the capacity of the fluid storage reservoir or reservoirs and the variation in pressure per unit time, the pumping device or devices starting or stopping according to the consumption flows and the most suitable combination of said devices.

In this particular case, the average consumption flow can be determined numerically and with a fair degree of accuracy, from the pressure variation for a variation in time since the effects thereof are the accumulation of the differences between consumption and pumping.

Determining the consumption flow quickly and economically enables the activation of the pumping devices of different sizes to be coordinated, both if the difference is accidental (in the case of expansions) or intentional (in the case of using a much smaller pump during the hours of low consumption; or flow relationships such as 1–2—2—2 or 1–2–4–8 for example). In the last case (1–2–4–8) the following productive combinations can be formed:

| | | | | |
|---|---|---|---|---|
| 1 | 2 | 3(=2+1) | 4 | 5(=4+1) |
| 6(=4+2) | 7(=4+2+1) | 8 | 9(=8+1) | 10(=8+2) |
| 11(=8+2+1) | 12(=8+4) | 13(=8+4+1) | 14(=8+4+2) | 15(=8+4+4+1) |

that is, 15 operational steps are available, with only four pumps, according to the consumption flow.

The operations can, in this case, be much more complex and therefore better adapted to the needs and/or requirements with a high degree of safety.

In one particular application case, the start pressure varies according to the load losses which increase with use and the build up of dirt in the fluid treatment and/or conditioning chains.

An example of this case occurs in circuits in which filter elements are arranged. This gives rise to notable energy savings the higher the requirements of purity of the fluid the higher the saving since there are more filtration elements.

In those cases where there are several minimum pressure values to be maintained, for different types of consumption, the same number of pressure storage reservoirs are provided, such that the pumping devices supply one reservoir or another and act as independent pumping stations, a pressure regulator being interposed between each two fluid storage reservoirs. In the case of simultaneous demand, the pumping devices supply those at the highest pressure.

In another particular case, where the flows generated by the pumping station are different from the nominal flows of the fluid treatment devices, the improvements of the invention are characterized in that devices are incorporated for the coordination between the volumes generated by the pumping station and the treatment capacity without regenerative action, said devices comprising a device which generates a signal which is proportional to the operating time and the flow of each pumping device, a pre-selector to select the volume as of which a coordination action is generated, a comparator device which gives a signal when the signal from the totalizer is greater than or equal to that of the pre-selector, and a system for resetting the individual counter devices proportional to the flow and the time, i.e. the volume.

This embodiment, apart from providing maximum performance within the context described herein, can also be applied to the majority of the currently used and existing procedures. An example for this realization is the regeneration of the adsorption driers, not with time but rather with flow actually circulated through the columns; the energy savings are in this case very considerable. Until now the absorption driers had to be similar in flow to the compressors whose flow they treated, the regeneration functioning with time. In this way, with the invention, apart from regenerating by volume the air of several different compressors can be treated, consuming only the flow necessary in the regeneration (until now it was between 12 and 15% of the nominal continuous flow, whereas with the invention it is only when the pre-determined number of cubic meters has been reached).

Finally, among the various embodiments and particular cases is the possibility that the pumping devices exchange their operating conditions in order to make their working conditions uniform and thereby balance both wear and number of start-ups per hour.

The same improvements can be applied to thermal stations consisting of boilers for heating, air conditioning, etc., in general, to fluid stations whose capacity is divided between several units with a randomly distributed consumption. The fluid can in fact be any kind: solid, liquid or gas, either continuous or discreet.

In particular, the fluid can be used to conduct heat and the various devices and parameters described above can be substituted for other analogous devices and parameters, such that the pumping devices can be substituted for heating devices, the pressure transducer for a temperature transducer, pressure for temperature, start pressure for start temperature, stop pressure for stop temperature, power for flow and consumption for fluid storage reservoirs.

BRIEF DESCRIPTION OF THE DRAWINGS

In order that the characteristics of the present invention be better understood, the accompanying drawings show by way of a non-limiting example a number of practical embodiments thereof.

In said drawings,

FIG. 2 is a graph of the pressure as a function of time showing the start pressure, stop pressure and emergency pressure for vacuum pumps;

FIG. 3 comprises two graphs, the upper one showing how the pressure varies as a function of time for one embodiment of the invention, the lower one showing the pumps in operation corresponding to the upper graph;

FIG. 8 refers to another embodiment and comprises two graphs, the upper one showing how the pressure varies as a function of time for said embodiment and the lower one showing the pumps in operation corresponding to the upper graph; and FIG. 9 refers to another embodiment with compressed air and comprises three graphs, the upper one corresponding to the changes in the operation of three compressors, the central one corresponding to output of the totalizer which adds the volume supplied by the set of pumping devices, and the lower one corresponding to the output of the comparator when the preselected value is reached.

DESCRIPTION OF THE PREFERRED EMBODIMENTS

Figure 1:
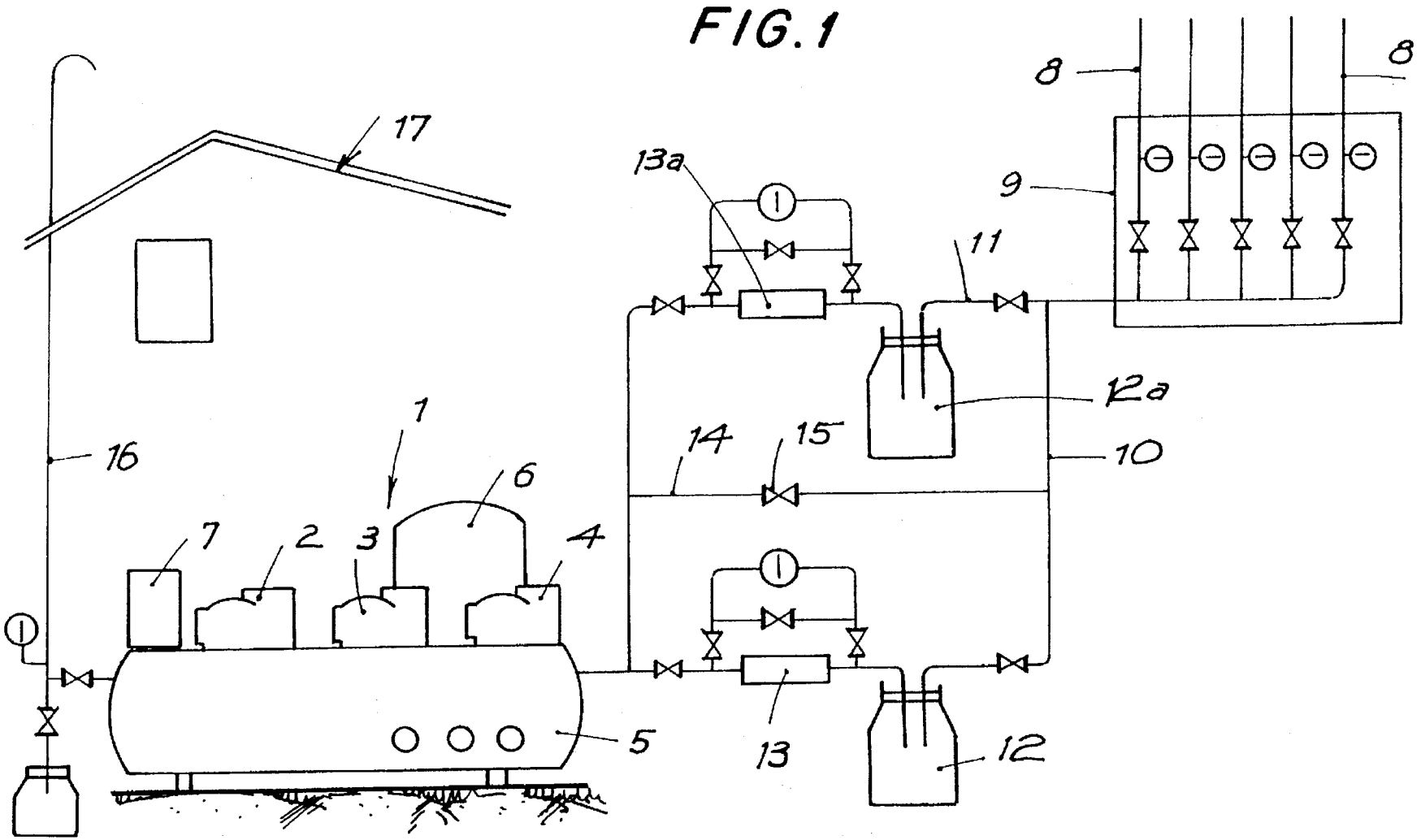
FIG. 1 shows schematically a vacuum station for hospitals.
Figure 16:
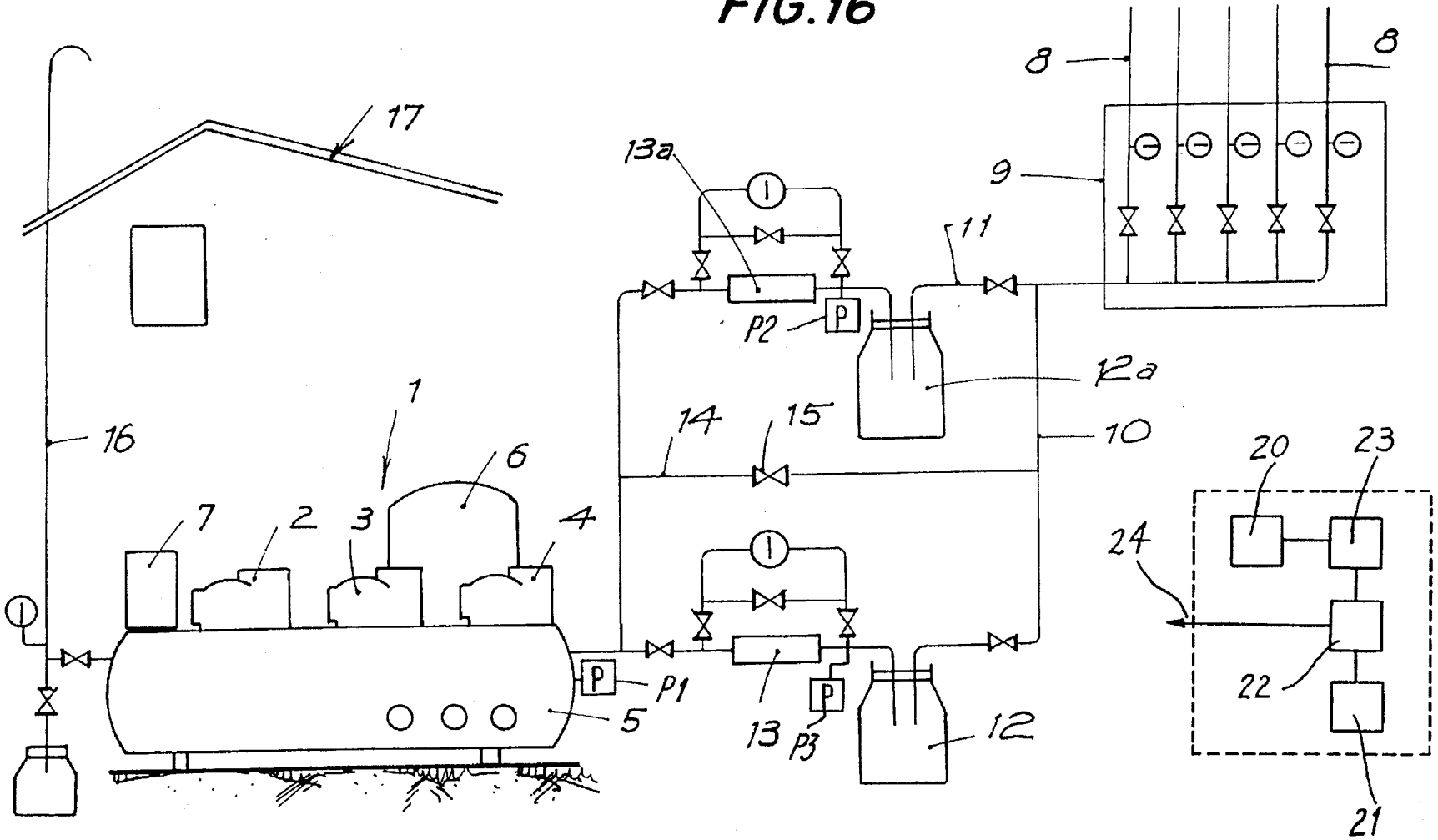
FIG. 16 shows a vacuum station, e.g., for hospitals, similar to that shown in FIG. 1 but including control means.

FIG. 1 shows a vacuum station 1 for hospitals comprising a plurality of vacuum pumps 2,3,4 a main drum 5, an auxiliary drum 6 and a control box 7 which receives signals from pressure transducers not shown. FIG. 16 shows a similar system showing the arrangement of the pressure transducers, viz, pressure transducer P1 associated with the main drum 5 (fluid storage reservoir) and pressure transducers P2,P3 associated with the pumping stations.

The vacuum station 1 produces a vacuum in a plurality of service lines 8 via a collector 9. Between the collector 9 and the station 1 two lines 10,11 are arranged in parallel. Each of them provided with a separating vessel 12,12*a* and a filter 13,13*a*. It is also provided with a direct or by-pass line 14 connected via a valve 15. Also shown is an outlet line 16 which protrudes from the building 17 with a condensation bottle 18 below.

FIG. 2 is a graph of the pressure as a function of time showing the start pressure VA, the stop pressure VP and the emergency pressure VE in vacuum pumps. Said figure shows the floatability of atmospheric pressure and it can be seen that the vacuum is a negative pressure relative to atmospheric pressure.

FIG. 3 corresponds to two graphs, the upper one showing how the pressure varies as a function of time for one embodiment of the invention and the lower one showing the pumps (B2,B3,B4) in operation corresponding to the upper graph. These pumps correspond to the references 2, 3 and 4 as shown in FIG. 1.

In the method examplified by this figure only one pump 2,3,4 is started when the pressure in the drums 5,6 (FIG. 1) reaches or exceeds the value of the start pressure VA and/or the flow provided by the pumps 2,3,4 in operation is less than the consumption flow, and only one pump 2,3,4 is stopped when the pressure in the drums 5,6 reaches the value of the stop pressure VP and when the flow provided by the pumps 2,3,4 in operation is greater than the consumption flow.

The difference between the flow provided by the pumps 2,3,4 and the consumption flow is determined from the change in the pressure after a certain interval of time, such that if after this interval of time the pressure is still beyond the start/stop level VA/VP a new pump 2,3,4 is started/stopped.

The interval of time T1,T2 depends on different parameters, such as the flow of the pumping devices and the mesh/star switching time of the motors which drive the pumping devices.

These characteristics can be appreciated by carefully analyzing the graphs shown in the figure.

Point A. Initially, only pump B2 is operational, the initial pressure taking on a value between the start and stop values.

Section A to B. The start pressure is reached. This indicates that the pump B2 is not enough for the consumption flow, and therefore pump B3 is started.

Section B to C. After a time T1, the pressure still exceeds the start pressure VA which shows that the sum of the flow of pump B2 and the flow of pump B3 is not enough for the consumption flow. Therefore pump B4 is started.

Section C to D. The pressure changes towards the stop position, which shows that the combined flow of the pumps (B2+B3+B4) is now greater than the consumption flow. When the stop pressure VP is reached the pump is disconnected, for example B4.

Section D to E. After a certain time T2, the pressure still exceeds the stop pressure, which indicates that the combined flow of the pumps (B2+B3) is still greater than the consumption flow, and therefore another pump has to be disconnected, for example B3.

Section E to F. After a time T2 the pressure is still below the stop pressure VP, which indicates that the flow of pump B2 is still greater than the consumption flow, and therefore another pump has to be disconnected, the only one in operation, pump B2.

Section F to G. None of pumps of the station are in operation, the pressure changing from a value beyond the stop pressure VP to the start pressure VA. When it crosses the start pressure a new pump is started, for example B4.

Section G to H. The fact that before a certain time T1 has expired a single pump makes the pressure change towards the stop pressure VP and cross the start pressure line VA, indicates that the flow of pump B4 is greater than the consumption flow in this period, and therefore it is not necessary for an additional pump to come into operation. When point H is reached pump B4 is stopped.

Figure 10:
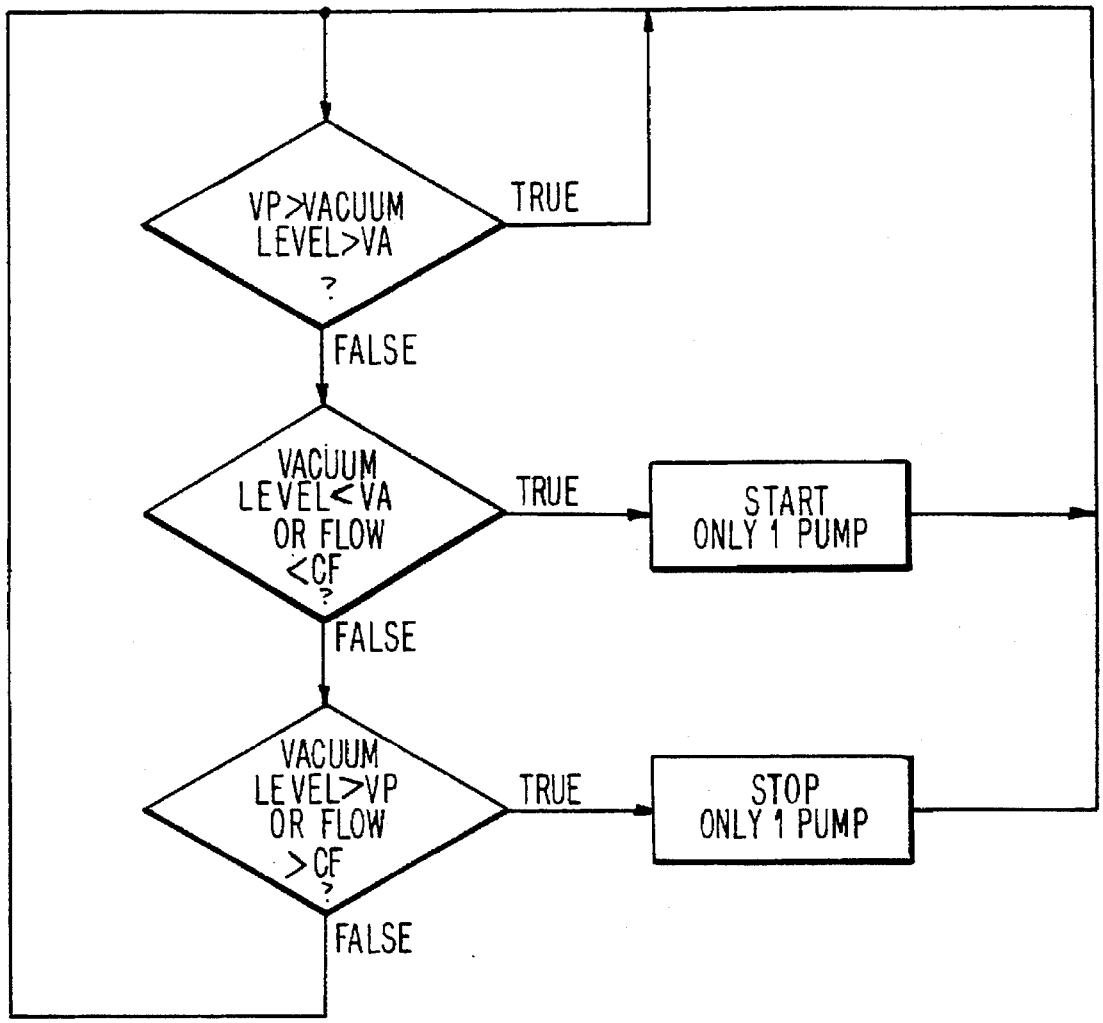
FIG. 10 is a block diagram showing a method used to obtain the results shown in FIG. 3.

Section H to M. When the start value VA is crossed a pump is started (for example B3). Nevertheless, the emergency level VE is reached and another pump (for example B2) is started. In a fraction of T1 (point K) another pump is started. The pressure changes and stabilizes at an intermediate point between the start value VA and the stop value VP and therefore no more pumps are started or stopped. FIG. 10 shows a block diagram of the regulation method described above, the results of which are illustrated in FIG. 3.

Figure 4:
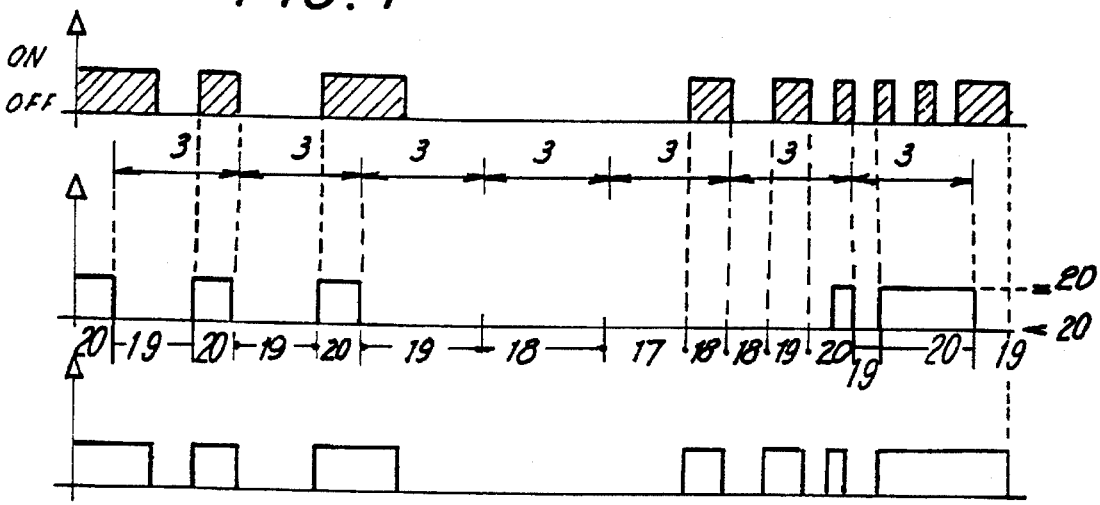
FIG. 4 shows another embodiment of the invention by means three graphs as a function of time, the upper one representing conventional operation, the central one representing the outputs of the start counter of the last sixty minutes, and the lower one representing the operation without a stand-by device.

FIG. 4 shows another embodiment of the invention by means of three graphs as a function of time.

In this embodiment, when the pressure in the storage reservoir reaches the value of the stop pressure VP, stopping only occurs as long as a certain number of start/stop cycles for each pump 2,3,4 is not exceeded.

The upper graph corresponds to the regulation outputs with the commands connection (ON) and stop (OFF) according to any of the methods described on pages 13 and 14 or simply conventional regulation described in the background of the invention. It should be pointed out that periods of three minutes are indicated corresponding to a maximum frequency of 20 operations per hour.

The central graph represents the outputs of the start counter of the last sixty minutes. The high level corresponds to having reached the maximum number of operations (in this example 20). The numbers written along the x-axis correspond to the value present in the start counter. The operation is as follows: for each start one unit is added to the counter. When the maximum value allowed (20) is reached a signal is generated which blocks the possibility of stopping. The number of starts which are being added are those corresponding to the position ON in the lower graph. Therefore, every ON increases one unit in the counter of the central graph. On the other hand, every three (3) minutes elapsed means a substraction of one unit in the counter.

The lower graph represents the operation without a standby device.

The pump 2,3,4 (FIG. 1) can stop when it is given the command by the general system, providing that the maximum number of operations has not been exceeded. This means that the stop signal (OFF) in the upper graph is temporarily canceled while the counter points out the preselected number of starts/hour (in the case of the figure, 20 starts/hour).

As shown in this figure, the start commands in the lower graph always coincide with the start commands in the upper graph whereas the stop commands only coincide when the pumping device has not carried out 20 starts/hour.

The example of the figure refers only to one single pump but it could be applicable to a plurality of pumps.

Figure 5:
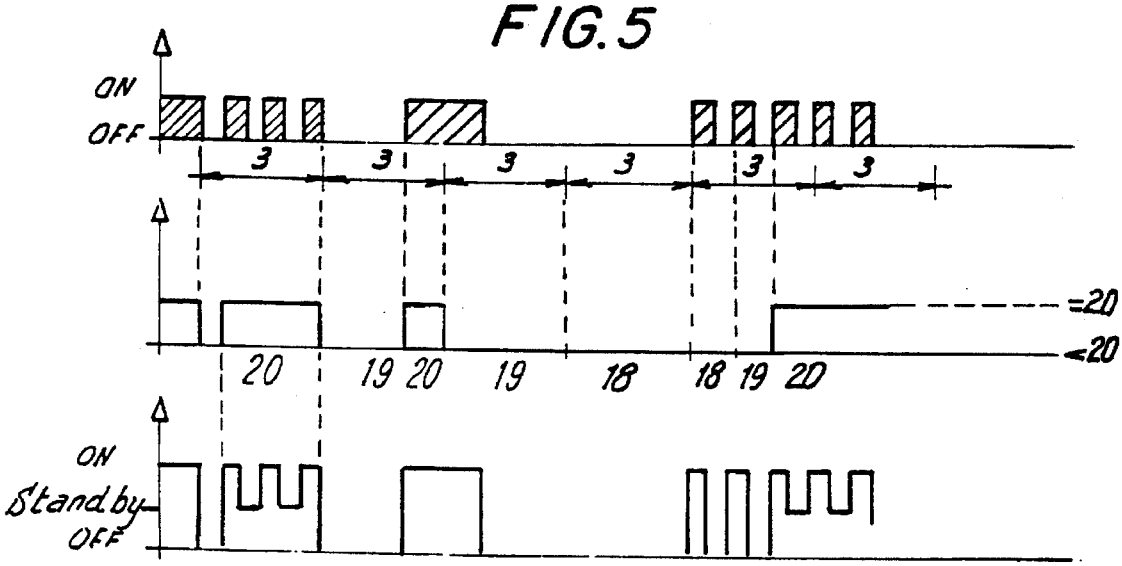
FIG. 5 shows another embodiment of the invention by means of three graphs as a function of time, the upper one representing conventional operation, the central one representing the outputs of the start counter of the last sixty minutes, and the lower one representing the operation with a stand-by device.

FIG. 5 shows another embodiment of the invention by means of three graphs as a function of time.

As in FIG. 4, when the pressure in the storage reservoir reaches the value of the stop pressure VP, stopping only occurs as long as a certain number of start/stop cycles for each pump 2,3,4 is not exceeded.

The upper graph corresponds to the regulation outputs with the commands connection (ON) and stop (OFF) according to any of the methods described or simply conventional regulation. It should be pointed out that periods of three minutes are indicated corresponding to a maximum frequency of 20 operations per hour.

The central graph represents the outputs of the start counter of the last sixty minutes. The high level corresponds to having reached the maximum number of operations (in this example 20). The numbers written along the x-axis correspond to the value present in the start counter. The operation is as follows: for each start one unit is added to the counter. When the maximum valued allowed (20) is reached a signal is generated which blocks the possibility of mechanical stopping but the pump 2,3,4 (FIG. 1) operates without pumping (stand-by operation), whilst there is a stop command, such that no more start-ups are made which could exceed the pre-selected figure, and if the pre-selected maximum is not reached and there is a stop command the pump can stop.

The lower graph represents stand-by operation. In said graph three levels are defined: un upper level corresponding to the operating mode, a middle level corresponding to stand-by mode operation, and a lower level corresponding to the pump 2,3,4 (FIG. 1) being stopped.

The final result is that the pump works in stand-by mode when there is a stop command from the regulation means and the maximum number of start-ups allowed has been reached. The pump stops when there is a stop command from the regulation means and the maximum number of start-ups allowed has not been reached. This means that the stop signal (OFF) in the upper graph is transformed into stand-by mode in the lower graph when the number of starts of the pump has reached 20 starts/hour and it only transforms into a stop signal when the number of starts has not reached this value.

The example of the figure refers only to one single pump but it could be applicable to a plurality of pumps.

Figure 11:
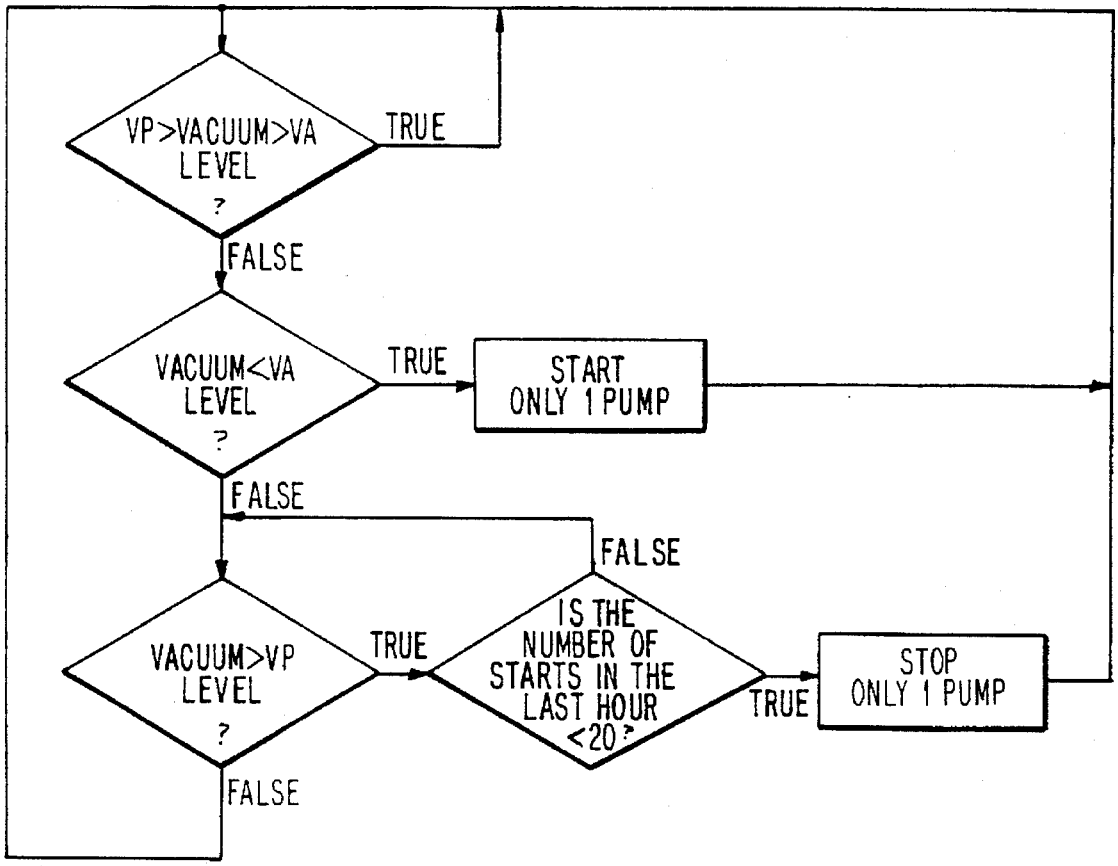
FIG. 11 is a block diagram showing a method used to obtain the results shown in FIGS. 4 and 5.

FIG. 11 shows a block diagram of the regulation methods described above, the results of which are illustrated in FIGS. 4 and 5.

Figure 6:
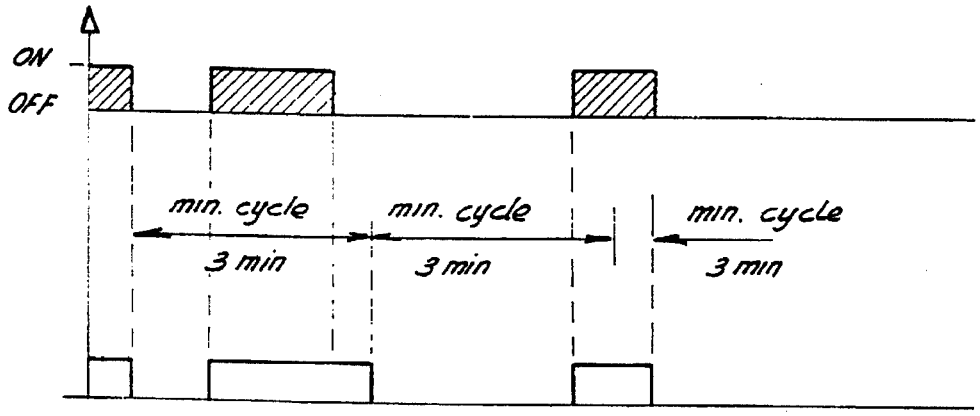
FIG. 6 shows another embodiment by means of two graphs, the upper one representing conventional operation and the lower one corresponding to a variant of a cycle without a stand-by device.

FIG. 6 shows another embodiment of the invention by means of two graphs as a function of time.

As in FIGS. 4 and 5, when the pressure in the storage reservoir reaches the value of the stop pressure VP, stopping only occurs as long as a certain number of start/stop cycles for each pump 2,3,4 is not exceeded.

The upper graph corresponds to the regulation outputs with the commands connection (ON) and stop (OFF) according to any of the methods described or simply conventional regulation. It should be pointed out that periods of three minutes are indicated corresponding to a maximum frequency of 20 operations per hour.

The lower graph corresponds to a variant of a cycle without a stand-by device.

The graph starts with a command to stop pump 2,3,4 (FIG. 1).

Then a time delay of three minutes is started, during which a start and a stop command are received. According to the method corresponding to the results in FIG. 6, the start-up is carried out but not the stop, since the three minutes minimum cycle is not over. The three minute time delay ends and therefore the pump can stop and does so. Thus the stop command (upper graph) is not effected (see lower graph) until the cycle of 3 minutes has not been finished. In this manner, it is not possible to effect more than one start-up every 3 minutes, that is, 20 start/hours are never exceeded.

A new time delay of three minutes is started, during which a start command is received and carried out. After the three minute time delay has ended the pump is free to stop when the regulation means give the command.

The regulation means send a stop command and the minimum cycle time delay is re-started. If the time delay were started on a start-up and the pumping device stopped before the three minutes ended, it would be unable to start up again, endangering the minimum values to be maintained.

Figure 12:
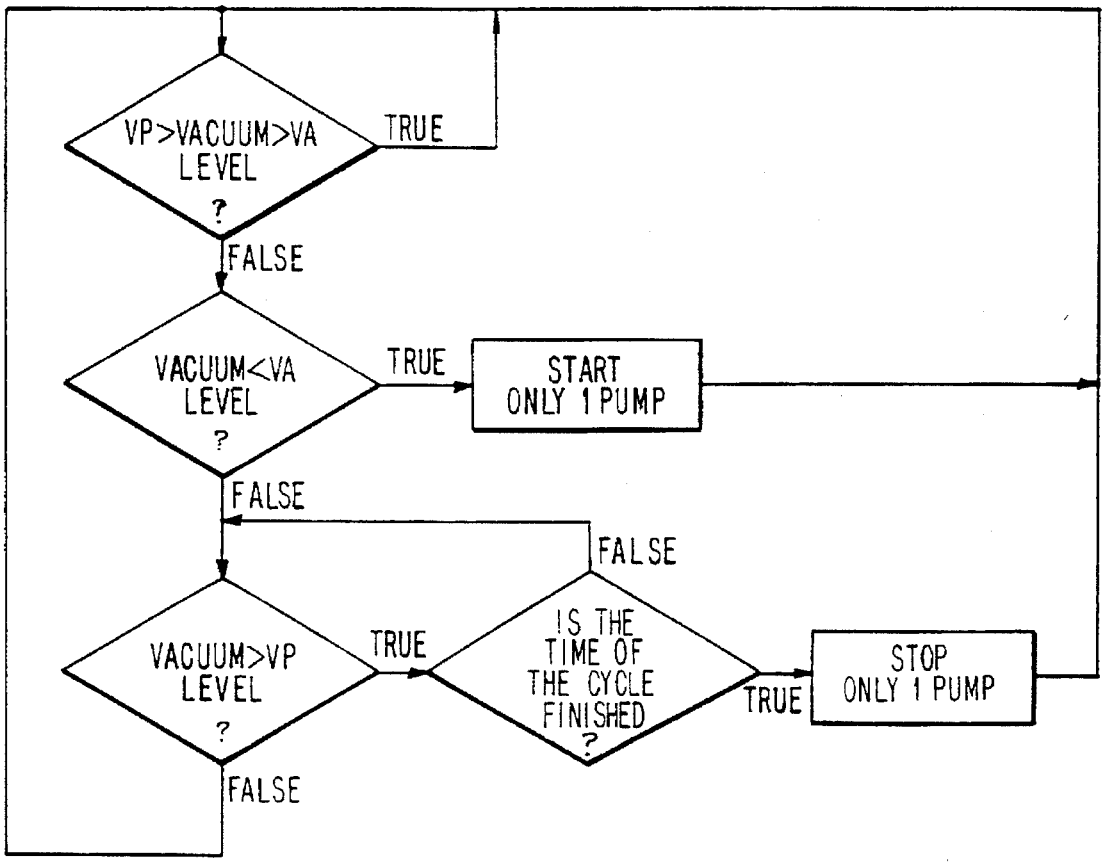
FIG. 12 is a block diagram showing a method used to obtain the results shown in FIG. 6.

If the system were to time a minimum duration of operation, for example for three minutes, it would be a costly solution in terms of energy. FIG. 12 shows a block diagram of the regulation methods described above, the results of which are illustrated in FIG. 6.

Figure 7:
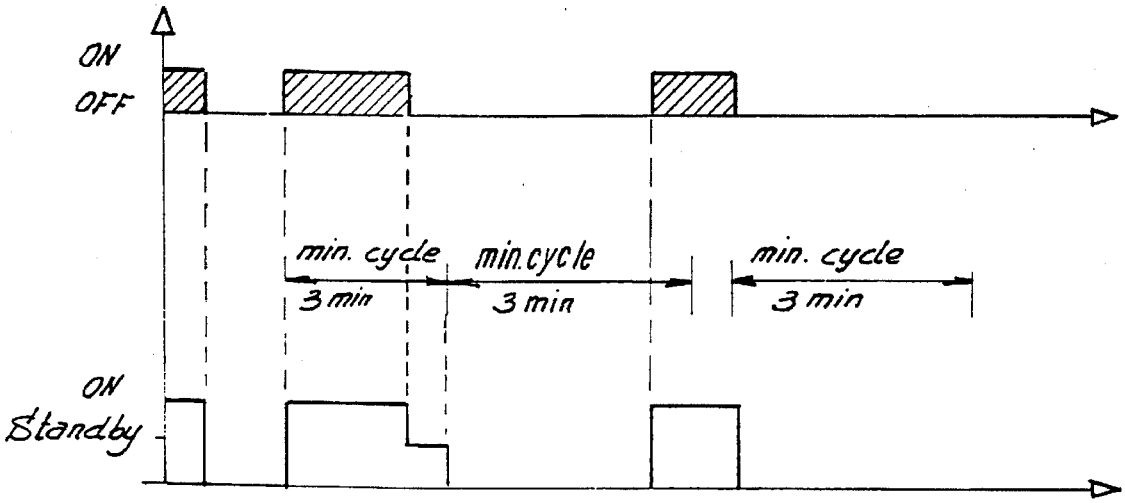
FIG. 7 shows another embodiment by means two graphs, the upper one representing conventional operation and the lower corresponding to a variant of a cycle with a stand-by device.

FIG. 7 shows another embodiment of the invention by means of two graphs as a function of time.

As in FIGS. 4, 5 and 6, when the pressure in the storage reservoir reaches the value of the stop pressure VP, stopping only occurs as long as a certain number of start/stop cycles for each pump 2,3,4 is not exceeded.

The upper graph corresponds to the regulation outputs with the commands connection (ON) and stop (OFF) according to any of the methods described or simply conventional regulation. It should be pointed out that periods of three minutes are indicated corresponding to a maximum frequency of 20 operations per hour.

The lower graph corresponds to a variant of a cycle with a stand-by device.

The graph starts with a command to stop pump 2,3,4 (FIG. 1).

Then a time delay of three minutes is started, during which a start and a stop command are received. According to the method corresponding to the results in FIG. 7, the start-up is carried out but not the stop, since the three minutes minimum cycle is not over, and it goes into stand-by operation.

On ending the three minute time delay, the pump can stop and does so, going from stand-by mode to stop mode.

A new time delay of three minutes is started, during which a start command is received and carried out. After the three minute time delay has ended the pump is free to stop when the regulation means give the command.

The regulation means send a stop command and the minimum cycle time delay is re-started. In this manner, the stop signal (OFF) in the upper graph is transformed into stand-by mode in the lower graph when the cycle of 3 minutes has not been finished. Again, in this case as well, the limit of more than one start-up every 3 minutes, that is, 20 starts/hours, is not exceeded. As in the preceding figures, the example of FIG. 7 refers only to one single pump but it could be applicable to a plurality of pumps.

Figure 13:
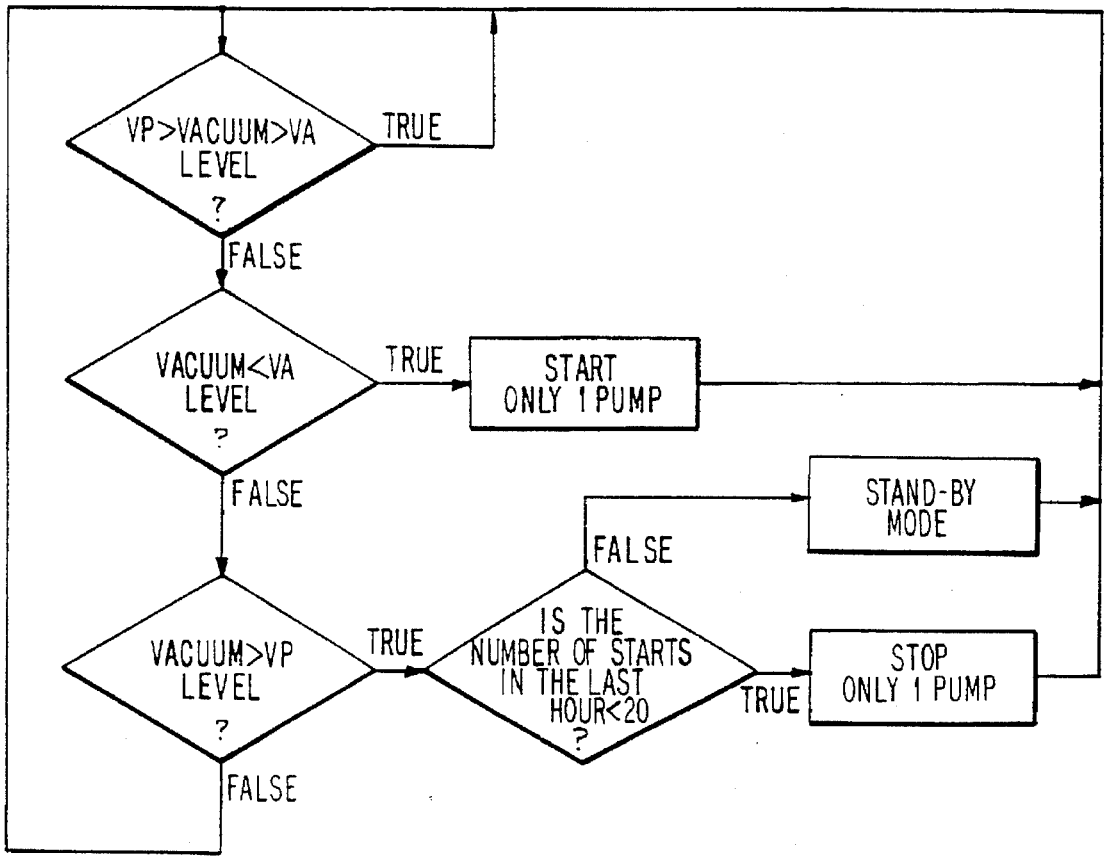
FIG. 13 is a block diagram showing a method used to obtain the results shown in FIG. 7.

FIG. 13 shows a block diagram of the regulation method described above, the results of which are illustrated in FIG. 7.

FIG. 8 comprises two graphs, the upper one showing how the pressure varies as a function of time for another embodiment of the invention and the lower one showing the pumps 2,3,4 in operation corresponding to the upper graph.

In this embodiment the difference between the flow provided by the pumping devices 2,3,4 (B2,B3,B4) and the consumption flow is determined from the known flow of each of the pumping devices, the capacity of the fluid storage reservoir or reservoirs 5,6 and the variation in pressure per unit time, the pumping device or devices 2,3,4 starting or stopping according to the consumption flows and the most suitable combination of the devices giving the total consumption flow of the pumping devices.

In the embodiment shown in this figure two methods are possible:

A first method, very simple, in which the consumption flow maintains a linear relationship between the flow, variation in pressure and size of the storage reservoir: $Q_1=f(\Delta p_1/\Delta t_1)$ wherein $Q_1$ is the consumption flow corresponding to the pressure variation $\Delta p_1$ for the time variation $\Delta t_1$ as shown in FIG. 8. In this manner, the consumption flow can be obtained knowing the pressure variation $\Delta p_1$ and the time variation $\Delta t_1$ since there is a linear relationship (in the general form y=ax+b) between the flow (y=Qc, b=Qm), the variation in pressure over time ($x=\Delta p/\Delta t$) and the size of the storage reservoir (a=C), e.g., $Qc=Qm-C\cdot\Delta p/\Delta t$ where Qc is the consumption flow in l/m (liters per minute), Qm is the flow of the compressors in l/m, $\Delta p$ is the pressure variation in bars during a time variation $\Delta t$ in minutes; and C is capacity of the fluid reservoir in liters (which is a standard relationship between these parameters). In the embodiment illustrated in FIG. 8, $Q_2$ and $Q_3$ may also be linear relationships wherein $Q_2$ equals $f(\Delta p_2/\Delta t_2)$ and is the consumption flow corresponding to the pressure variation $\Delta p_2$ for the time variation $\Delta t_2$ and $Q_3$ equals $f(\Delta p_3/\Delta t_3)$ and is the consumption flow corresponding to the pressure variation $\Delta p_3$ for the time variation $\Delta t_3$.

Figure 14:
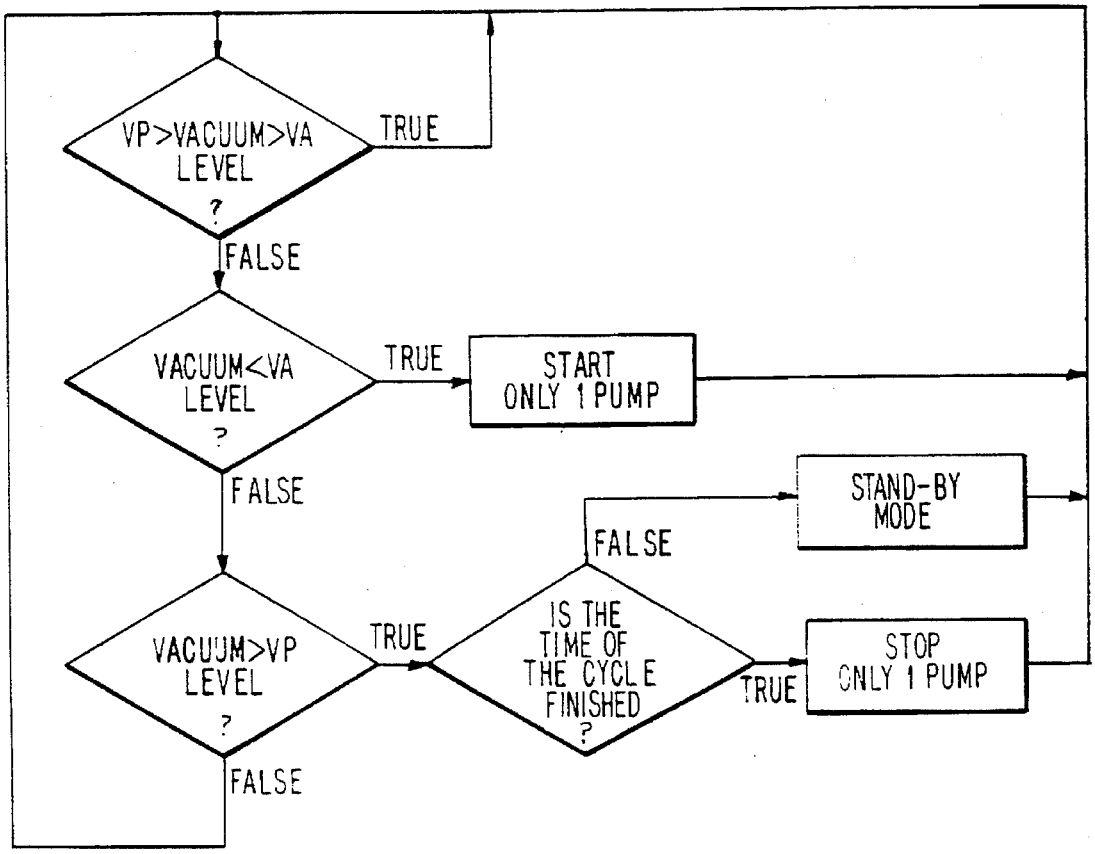
FIG. 14 is a block diagram showing a method used to obtain the results shown in FIG. 8.

A second method, more complex, in which the relationship between the flow, the variation in pressure over time and the size of the storage reservoir is non-linear, e.g., exponential or logarithmic:

FIG. 14 shows a block diagram of the regulation method described above, the results of which are illustrated in FIG. 8.

Figure 15:
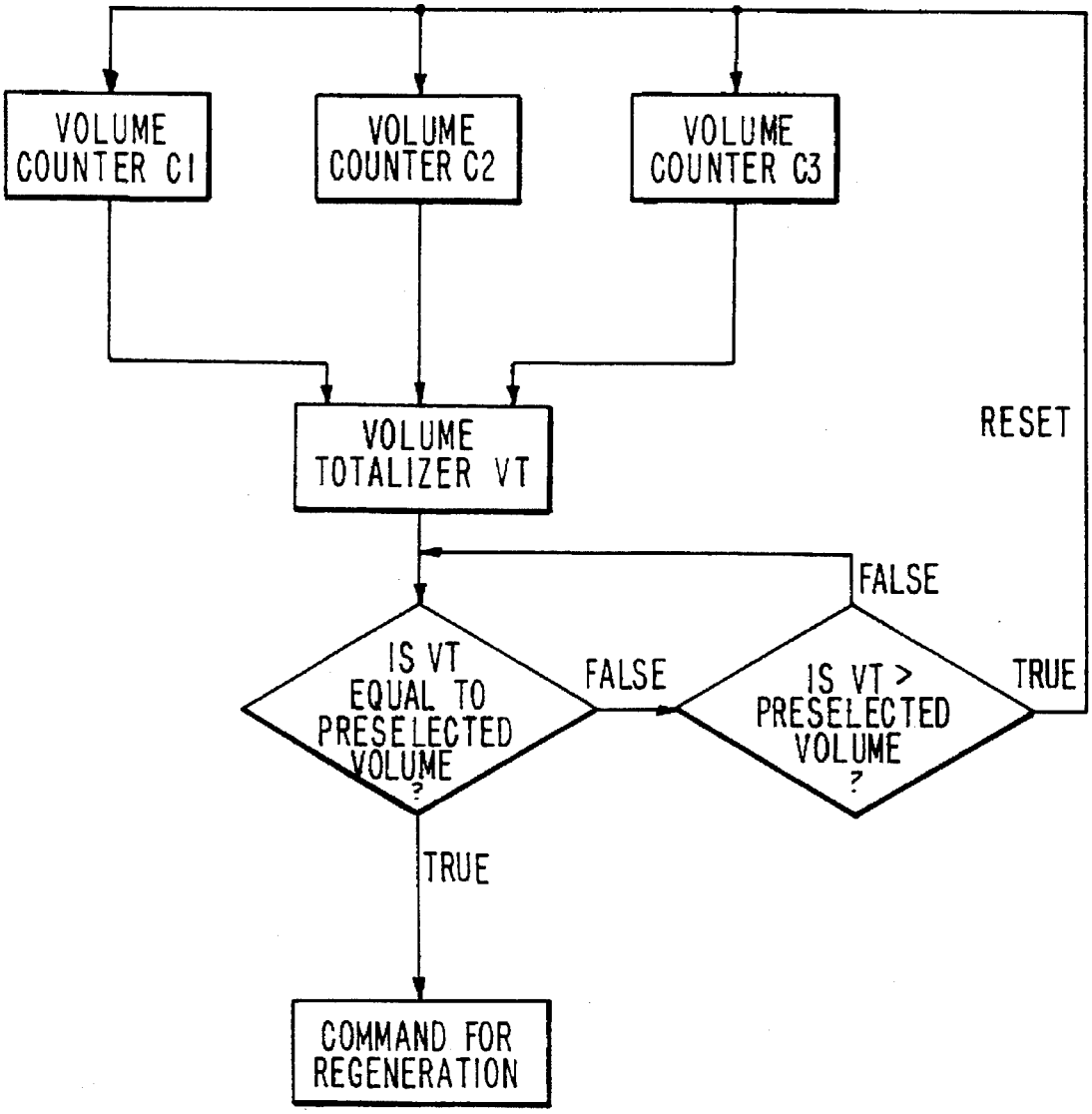
FIG. 15 is a block diagram showing a method used to obtain the results shown in FIG. 9.

FIG. 15 shows a block diagram of this regulation method and FIG. 16 shows an apparatus for possible realization of this regulation method. FIG. 9 comprises three graphs:

The upper graph corresponds to the changing operation of three compressors, the central graph corresponds to the output of the totalizer which adds the volume supplied by the set of pumping devices, and the lower graph corresponds to the output of the comparator which compares the volumes between the volume of the fluid which has flowed through the fluid treatment device and the preselected volume assigned to the device when the preselected value is reached.

This embodiment refers to the case in which the volumes generated by the pumping station are different to the volumes of the fluid treatment devices, and for regulation a number of devices are incorporated for coordinating between the pumping station and the fluid treatment devices, said devices comprising a device 20 which generates a signal which is proportional to the operating time and the flow of each pumping device, a pre-selector 21 to select the volume as of which a coordination action is generated, a comparator device 22 which gives a signal 24 when the signal from the totalizer 23 is greater than or equal to that of the pre-selector, and a system for resetting the individual counter devices proportional to the flow and the time. By way of an example of a conventional unit, the control means 20 include an adjustable reference tension or voltage unit 25, voltage dividers 26, 27, 28 providing corresponding voltages which are proportional to the flow of different compressors 1, 2, 3, corresponding voltage/frequency converters 29, 30, 31 and corresponding counters 32, 33, 34 which provide the signals to the totalizer 23. The system for resetting the counters 32, 33, 34 is thus formed by the connection between the comparator 22 and the counters 32, 33, 34.

There follows a brief description of the central graph:

Section A–B and B–C. This corresponds to a single pumping device which implies a minimum slope.

Section C–D and D–E. This corresponds to two pumping devices, for which the gradient is greater (the preselected value is reached sooner). The gradients are the same in section C–D and the section D–E, since in both cases two compressor of the same capacity are operating as shown in the upper graph.

Section E–F. As there are three pumping devices the gradient is much greater.

Section F–G. The gradient is the same as that of A–B and B–C.

Section G–H. The output remains constant since there are no pumping devices operating.

Section H–I. The gradient is the same as that of A–B and B–C.

As shown in the lower graph the regeneration commands take place at non-homogeneous intervals. They always take place when the volume has reached its preselected value as shown in the central graph. It is pointed out that the block diagrams of the regulation methods as shown in FIGS. 10–15 show the control of each pump individually, i.e., the operation of one pump is affected based on the conditions in the fluid storage reservoir at each time.

We claim:

1. In a method for regulating a fluid conditioning station including pumping devices for pumping a fluid, at least one fluid storage reservoir coupled to said pumping devices, at least one pressure transducer and regulating means coupled to said at least one fluid storage reservoir and said pumping devices for regulating the pressure in said at least one fluid storage reservoir, means for determining the consumption flow of the fluid conditioning station and means for determining a first, start pressure and a second, stop pressure of said at least one fluid storage reservoir, the pressure in said at least one fluid storage reservoir being maintained between the first pressure and the second pressure by regulating starting of a non-operating one of said pumping devices and stopping of an operating one of said pumping devices, the improvement comprising:

starting only one of said pumping devices if the pressure in said at least one fluid storage reservoir reaches or exceeds the first pressure regardless of the extent to which it exceeds the first pressure or if the flow of fluid provided by said pumping devices measured at their respective operating pressures is less than the consumption flow of the fluid conditioning station, and stopping only one of said pumping devices if the pressure in said at least one storage reservoir reaches the second pressure or if the flow of fluid provided by said pumping devices measured at their respective operating pressure is greater than the consumption flow of the fluid conditioning station.

2. The method of claim 1, further comprising the steps of:

determining the first pressure according to limit values to be maintained in said at least one storage reservoir, and determining the second pressure according to the number of times said pumping devices start per unit time.

3. The method of claim 1, further comprising the step of:

determining a difference between the flow provided by said pumping devices and the consumption flow from a change in pressure in said at least one fluid storage reservoir after an interval of time after a single one of said pumping devices is started or stopped, and if after the interval of time, the pressure is less than the first pressure, starting an additional one of said pumping devices, or if after the interval of time, the pressure is greater than the second pressure, stopping an additional one of said pumping devices.

4. The method of claim 3, further comprising the step of calculating the interval of time as a function of at least one of the flow of said pumping devices and the mesh/star switching time of motors which drive said pumping devices.

5. The method of claim 3, wherein said pumping devices operate above atmospheric pressure, further comprising the step of providing a maximum safety pressure of said at least one fluid storage reservoir, and stopping all of said pumping devices if the pressure in said at least one fluid storage reservoir reaches the safety pressure.

6. The method of claim 1, further comprising the step of regulating the starting and stopping of each of said pumping devices based on a different first and second pressure of said at least one fluid storage reservoir.

7. The method of claim 1, further comprising the step of determining a difference between the flow of fluid provided by said pumping devices and the consumption flow from a known flow of each of said pumping devices, the capacity of said at least one fluid storage reservoir and a variation in pressure of said at least one fluid storage reservoir per unit time.

8. The method of claim 1, further comprising the step of operatively varying the first pressure according to load losses of said pumping devices which increase with use and build up of dirt and impurities in fluid treatment and conditioning chains in the fluid conditioning station.

9. The method of claim 1, further comprising the steps of:

coupling said pumping devices to a respective one of a plurality of fluid treatment devices, the flows of fluid being generated by said pumping devices being different from the flows of the fluid treatment devices, and coordinating the fluid volumes generated by said pumping devices and the fluid treatment capacity of said fluid treatment devices without regenerative action by interposing a coordination device between each of said pumping devices and a respective one of said fluid treatment devices, each of said coordination devices comprising signal generating means for generating a signal proportional to the operating time and the flow of the respective one of said pumping devices, said signal generating means comprising individual counter devices registering values proportional to the flow and the operating time, a preselector coupled to said signal generating means for selecting the volume as of which a coordination action is generated, a totalizer coupled to said signal generating means, comparator means coupled to said preselector and said totalizer for providing a signal when the signal from said totalizer is greater than or equal to a signal from said preselector, and a system for resetting said individual counter devices.

10. The method of claim 1, further comprising the steps of:

subsequently starting only a single additional one of said pumping devices each discrete time the pressure in said at least one fluid storage reservoir reaches or exceeds the first pressure regardless of the extent to which it exceeds the first pressure or the flow of fluid provided by said pumping devices measured at their respective operating pressure is less than the consumption flow of the fluid conditioning station, and subsequently stopping only a single additional one of said pumping devices each discrete time the pressure in said at least one storage reservoir reaches the second pressure or the flow of fluid provided by said pumping devices measured at their respective operating pressure is greater than the consumption flow of the fluid conditioning station.

11. In a method for regulating a fluid conditioning station including pumping devices for pumping a fluid, at least one fluid storage reservoir coupled to said pumping devices, at least one pressure transducer and regulating means coupled to said at least one fluid storage reservoir and said pumping devices for regulating the pressure in said at least one fluid storage reservoir, means for determining the consumption flow of the fluid conditioning station and means for determining a first, start pressure and a second, stop pressure of said at least one fluid storage reservoir, the pressure in said at least one fluid storage reservoir being maintained between the first pressure and the second pressure by regulating starting of a non-operating one of said pumping devices and stopping of an operating one of said pumping devices, the improvement comprising:

stopping at least one of said pumping devices only if the pressure in said at least one storage reservoir reaches the second pressure, and:

a certain number of start and stops per unit time of one of said pumping devices is not exceeded, or a minimum duration between consecutive stoppages of one of said pumping devices is exceeded, or a minimum operating time from the preceding start of one of said pumping devices is not reached.

12. The method of claim 11, further comprising the steps of determining the first pressure according to limit values to be maintained in said at least one storage reservoir, and determining the second pressure according to the number of times said pumping devices start per unit time.

13. The method of claim 11, further comprising the step of determining a difference between the flow of fluid provided by said pumping devices and the consumption flow is determined from a known flow of each of said pumping devices, the capacity of said at least one fluid storage reservoir and a variation in pressure of said at least one fluid storage reservoir per unit time.

14. The method of claim 11, further comprising the step of operatively varying the first pressure according to load losses of said pumping devices which increase with use and build up of dirt and impurities in fluid treatment and conditioning chains in the fluid conditioning station.

15. The method of claim 11, further comprising the steps of:

coupling said pumping devices to a respective one of a plurality of fluid treatment devices, the flows of fluid being generated by said pumping devices being different from the flows of the fluid treatment devices, and coordinating the fluid volumes generated by said pumping devices and the fluid treatment capacity of said fluid treatment devices without regenerative action by interposing a coordination device between each of said pumping devices and a respective one of said fluid treatment devices, each of said coordination devices comprising signal generating means for generating a signal proportional to the operating time and the flow of the respective one of said pumping devices, said signal generating means comprising individual counter devices registering values proportional to the flow and the operating time, a preselector coupled to said signal generating means for selecting the volume as of which a coordination action is generated, a totalizer coupled to said signal generating means, comparator means coupled to said preselector and said totalizer for providing a signal when the signal from said totalizer is greater than or equal to a signal from said preselector, and a system for resetting said individual counter devices.

16. The method of claim 11, wherein said at least one of said pumping devices is stopped only if the pressure in said at least one storage reservoir reaches the second pressure and a certain number of start and stops per unit time of one of said pumping devices is not exceeded.

17. The method of claim 11, wherein said at least one of said pumping devices is stopped only if the pressure in said at least one storage reservoir reaches the second pressure and a minimum duration between consecutive stoppages of one of said pumping devices is exceeded.

18. The method of claim 11, wherein said at least one of said pumping devices is stopped only if the pressure in said at least one storage reservoir reaches the second pressure and a minimum operating time from the preceding start of one of said pumping devices is not reached.

* * * * *